US008119073B2

(12) United States Patent
Stone et al.

(10) Patent No.: US 8,119,073 B2
(45) Date of Patent: Feb. 21, 2012

(54) METHOD AND DEVICE FOR PARTICULATE SCRUBBING AND CONDITIONING

(75) Inventors: Ashley Stone, Orillia (CA); Martin Kestle, Everett (CA)

(73) Assignee: Ashley Stone, Orillia (CA)

( * ) Notice: Subject to any disclaimer, the term of this patent is extended or adjusted under 35 U.S.C. 154(b) by 787 days.

(21) Appl. No.: 12/194,838

(22) Filed: Aug. 20, 2008

(65) Prior Publication Data

US 2009/0081088 A1 Mar. 26, 2009

Related U.S. Application Data

(60) Provisional application No. 60/935,561, filed on Aug. 20, 2007.

(51) Int. Cl.
*F27B 15/08* (2006.01)

(52) U.S. Cl. ..... 422/147; 95/14; 95/23; 95/171; 95/204; 96/376; 96/379

(58) Field of Classification Search ..... 422/147, 422/611; 95/14, 23, 171, 204; 96/189, 376, 96/379, 397

See application file for complete search history.

(56) References Cited

U.S. PATENT DOCUMENTS 4,430,116 A * 2/1984 Yamazaki et al. ..... 75/505
4,804,167 A * 2/1989 Kock et al. ..... 266/186
5,280,757 A * 1/1994 Carter et al. ..... 110/346
5,385,601 A * 1/1995 Kemeny et al. ..... 75/748
5,501,266 A 3/1996 Wang et al.
5,826,518 A * 10/1998 Bhat et al. ..... 110/216
6,855,183 B1 * 2/2005 Pierce, Jr. ..... 75/10.22
7,942,951 B2 * 5/2011 Johnsgard et al. ..... 95/149
2001/0052405 A1 12/2001 Takizawa et al.
2002/0124988 A1 9/2002 Takizawa et al.

OTHER PUBLICATIONS

Hodiamont, S.; Search Report from European Application No. 09004312.6; search completed Jul. 16, 2009.

* cited by examiner

*Primary Examiner* — Nina Bhat

(74) *Attorney, Agent, or Firm* — John R. S. Orange; Blake, Cassels & Graydon LLP

(57) ABSTRACT

Described is a device for conditioning a comminuted light alloy feedstock to heat and remove impurities from the feedstock. The conditioner device includes a reaction chamber having a substrate feed port for feeding the comminuted light alloy feedstock into the reaction chamber and a discharge port for allowing the conditioned feedstock to exit the reaction chamber. A scrubber gas baffle is positioned at one end of the reaction chamber and coupled to a scrubber gas injector which is configured to inject a scrubber gas through the scrubber gas baffle at a volume and rate of flow sufficient to fluidize the feedstock in the reaction chamber. A scrubber gas heater is also provided for heating the scrubber gas to a temperature sufficient to condition the feedstock as desired.

20 Claims, 5 Drawing Sheets

METHOD AND DEVICE FOR PARTICULATE SCRUBBING AND CONDITIONING

CROSS-REFERENCE TO RELATED APPLICATION

This application claims the benefit of U.S. provisional patent application Ser. No. 60/935,561 filed Aug. 20, 2007 and regularly filed application Ser. No. 12/098,368 filed Apr. 4, 2008, the entirety of which are incorporated herein by reference.

FIELD OF THE INVENTION

The invention relates generally to methods and devices for scrubbing and conditioning particulate feed stock for use in metal casting.

BACKGROUND OF THE INVENTION

Processing light metal alloys in a conventional way involves one of the two well know processes, namely cold chamber or hot chamber die-casting methods. These processes use melting furnace to melt light alloy at superheated temperatures and than inject the molten metal into a re-usable mold. Recycled material is also re-melted in the same furnace. In the process of melting magnesium cover gas is used to prevent magnesium from evaporation and burning. The cover gas used is often $SF_6$ Sulfur hexafluoride. A report by the US World Resources Institute reported that the global warming potential for $SF_6$ is 23,900 relative to $CO_2$. This means that 1 kg of $SF_6$ in the atmosphere gives approximately same contribution to green house effect as 24 tonnes of $CO_2$ per tonne of the magnesium smelted. This gas is the dominant greenhouse contributor for magnesium smelters and die-casters. The life time of $SF_6$ in the atmosphere is estimated to be 3200 years. Due to these environmental problems, new processes that do not require potent $SF_6$ gas are being searched for worldwide.

Feedstock is often contaminated with organic and inorganic inclusions coming from various contamination points in a life cycle of the feedstock. These inclusions are often introduced by the chip manufacturer unintentionally due to poor process quality control. Organic inclusions could be dust or lint, for example. Some of the contamination is sourced back to exposure to environment and handling from start of the chip manufacturing to end use location. Recycled magnesium chips are often too contaminated by the oil, water, wax, mold release etc. If used in a casting process, these chips would make poor quality parts unsuitable for demanding automotive industry.

During processing, these inclusions and foreign material end up in the part and are seen in the castings, by metallurgical evaluation, as voids or are often converted with help of high melt temperature into oxides with very high re-melt temperature. The water molecules, on the other hand, and entrapped air or other gasses from the air get attached to the highly stressed surface of the comminuted particle due to known physical principles mostly in acute curvature of the chip. This causes in-homogeneity in melt and subsequently affects part quality. The water affects processing of the magnesium (not exclusive to magnesium) by creating explosive conditions where water is cracked into $O_2$ and $H_2$. The hydrogen $H_2$ could create explosive mixture and unsafe processing. Humidity is undesirable within the feedstock. Attached molecules of other elements or gasses like oxygen and nitrogen to the chips are also undesirable input to the casting process.

All current, environmentally friendly, light metal casting processes could benefit from fine feedstock that is clean, free of all contaminants, oxygen and nitrogen free. When this feedstock is then pre-heated to 150° C., preferably up to 200° C. or even up to 250° C., or even more preferably up to 400° C. (for magnesium) it can significantly improve part quality and metallurgical properties of the casting. All processes using granulated feedstock may benefit from the current invention by receiving down stream clean, conditioned and tempered feedstock that is scrubbed from all contaminants and dried from moisture as well as purged from inclusions of air contaminants like chemically unattached oxygen and nitrogen molecules. Heating metallic feedstock is not being currently practiced in industry. Heating uniformly shaped feedstock is a challenge, but heating chips of non-uniform and random shapes is very difficult with any conventional heating means.

There are number of apparatuses claiming successful treatment of granular feedstock, but it is not known to these inventors, any application where randomly shaped light metal alloy chips are successfully and uniformly heated in temperature range 100° C. to 460° C. Heating granular substances other than light metal alloys has been used in industry for a long time. One form of the device for treating particulate product is U.S. Pat. No. 6,367,165 B1 where a granular product for generic pharmaceutical application claims the benefit of the baffle plate to distribute air in the fluidized chamber. Substantially horizontal input of air is claimed as main feature of this apparatus. Another disclosure U.S. Pat. No. 4,967,688 to Yoshiro at al., discloses powder processing apparatus with a rotating air permeable blades used to apply thin coating to chemical powders, treatment of food products and ceramic powders by liquid to apply thin coat of film to the particles. Both above disclosures are batch type structures. No cleaning and scrubbing features are mentioned or claimed in these disclosures.

In U.S. Pat. No. 4,372,053 Anderson et al. relates to a method of drying particulate material within an enclosed chamber. Heating and cooling fluids are introduced in particular zones of the dryer to accomplish particular moisture content of the various grains, like corn prior to storage.

In another U.S. Pat. No. 4,346,054 a fluidized bed apparatus is used for temperatures >700° C. processing iron ore where fluidizing medium is under high pressure and is $CO_2$, $N_2$ and or air. This also is a batch type fluidization apparatus. There seems to be a plethora of applications of the fluidized bed for efficient burning of organic matter and extracting heat from the burning medium. The U.S. Pat. No. 6,139,805 issued to Shuichi at al. using solid material containing a combustible and non-combustible material. Heat energy extracting plates are within fluidized bedchamber in a singular or multiple arrangements.

None of the prior art describes the apparatus for heating metallic particles in a continuous process where fluidization and energy input transfer is done by the same fluidizing medium and/or by the recycled heat from other processes. So, there is a need for heating and scrubbing light metal particles from environmental contaminants and gases in a continuous manner with no adverse environmental impact and Greenhouse Gas Emissions.

SUMMARY OF THE INVENTION

In accordance with one aspect of the present invention, there is provided a device for conditioning a comminuted light alloy feedstock to heat and remove impurities from the feedstock. The conditioner device includes a reaction chamber having a substrate feed port for feeding the comminuted light alloy feedstock into the reaction chamber and a discharge port for allowing the conditioned feedstock to exit the reaction chamber. A scrubber gas baffle is positioned at one end of the reaction chamber and coupled to a scrubber gas injector which is configured to inject a scrubber gas trough the scrubber gas baffle at a volume and rate of flow sufficient to fluidize the feedstock in the reaction chamber. A scrubber gas heater is also provided for heating the scrubber gas to a temperature sufficient to condition the feedstock as desired.

In accordance with another aspect of the present invention, there is provided a device for conditioning a comminuted light alloy feedstock by scrubbing the feed stock with a heated inert scrubber gas sufficiently to drive off impurities such as water vapor, $O_2$ and other impurities. The device includes a reaction chamber having an upper end and a lower end. A substrate feed port for feeding the comminuted light alloy feedstock into the reaction chamber is positioned adjacent the upper end of the reaction chamber and a scrubber gas baffle is positioned adjacent the lower end of the reaction chamber for releasing a scrubber gas into the reaction chamber. A scrubber gas injector is provided for adjusting the volume and rate of flow of the scrubber gas released through the scrubber gas baffle sufficiently to fluidize the comminuted light alloy feedstock in the reaction chamber. A scrubber gas heater is provided for heating the scrubber gas to a temperature sufficient to condition the comminuted light alloy feedstock as desired, and a discharge port is provided for allowing the conditioned comminuted light alloy feedstock to exit the reaction chamber.

In accordance with another aspect of the present invention, there is provided a feed stock conditioning device as described in the above paragraphs wherein the scrubber gas injector comprises at least one gas amplifier contained within a scrubber gas accumulation chamber positioned adjacent the scrubber gas baffle. The gas amplifier is oriented such that the scrubber gas is made to flow through the scrubber gas baffle.

In accordance with another aspect of the present invention, there is provided a feed stock conditioning device as described in the preceding paragraph wherein the discharge port is formed on a discharge tube mounted within the reaction chamber, the discharge tube being movable within the reaction chamber such that the position of the discharge port relative to the bottom of the reaction chamber can be selected.

In accordance with another aspect of the present invention, there is provided a feed stock device as described in the preceding paragraph further including a cowl mounted within the reaction chamber, the cowl surrounding the discharge tube.

In accordance with another aspect of the present invention, there is provided a feed stock device as described in the preceding paragraph further including a first and second temperature sensor for reading a first and second temperature corresponding to the temperature of the feed stock adjacent the substrate feed port and adjacent the scrubber gas baffle, respectively.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
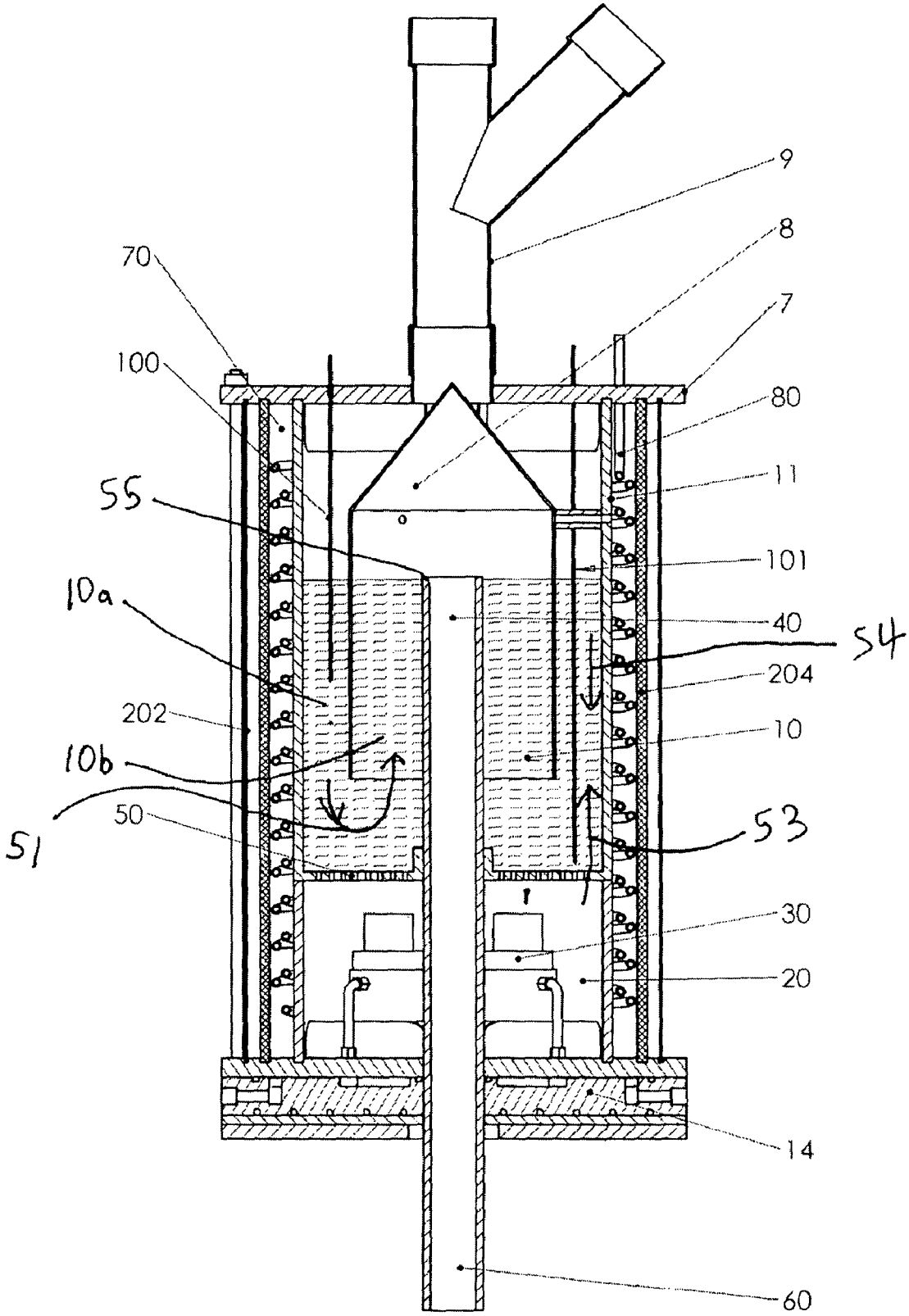
FIG. 1. is a perspective view of a structure for particulate scrubbing and conditioning immediately before use in the downstream processes.

New processing techniques for casting light metal alloy that does not require use of $SF_6$ is described in co-pending U.S. patent Ser. No. 12/098,368, the entirety of which is incorporated herein by reference. In this previous application to Stone at al., U.S. patent Ser. No. 12/098,368 we describe a method of processing magnesium by using, as a input to the process, cold mechanically comminuted chips or rapidly solidified granules which both possess unique micro structural features that facilitate transformation of the solid particles into semi solid slurry by heating it only. In the totally enclosed process, chips or granules are, by way of adding heat only, transformed into a semi liquid state that is then pushed into a closed mold and quickly solidified without need for cover gas. During the melting process it was observed that localized magnesium burning occurs during the processing cycle. While it occurs inside the totally enclosed confines of the melt containing barrel, it was observed by metallurgical analysis of the cast part. It was discovered that molecules of oxygen and $CO_2$ mixed with water mist and humidity from air remains entrained in the feedstock and at the suitably high melt temperature, mixture of these compounds in contact with molten metal starts an intense oxidation process. While effects of $N_2$ cause deterioration of the melt containment vessel, oxidation causes poor part quality. In this application scrubbing refers to the process of removing unwanted substances from the feedstock by the method and apparatus disclosed herein. Conditioning refers to a process of matching feedstock properties to the process input requirements. In this application, we will discuss effects of the oxidation caused by humidity and oxygen on the magnesium melt; however aluminum or other light metal alloys are susceptible to a similar phenomenon as well. In the case of magnesium melting, localized oxidation flare-ups, result in creation of the MgO structure that in the solidified parts can create high stress concentration and start material cracks. This is a disadvantage for high integrity castings used for automotive and other industries. Slightly different source for this kind of material contamination can be found when we use recycled magnesium alloy.

Additionally, during processing, we have unexpectedly noticed, that feeding granular alloy into the melting barrel heated at 600° C. causes sudden increase in thermal gradients, resulting in stress in the containment barrel causing premature barrel failure. When a slower granulate feeding approach was adopted by experimentation, it was discovered that thermal gradients are sustainable but the rate of production is reduced by more than 25%. The water content in the feedstock can cause uneven heating due to latent heat of water that tends to slow down heating of the feedstock, as was observed with our experiments. To increase material throughput, it was necessary to pre-heat the granular material to at least 200° C.

We have observed significant improvement in the integrity of the cast parts and high integrity casting was possible with this process.

In order to solve the above problems, it is an object of the present invention to provide an apparatus and structure to scrub the magnesium feedstock from organic contaminants, moisture, oxygen $O_2$ and nitrogen $N_2$ etc. that could be present in the feedstock material in a batch and/or continues flow. It is further object of this invention to uniformly preheat the feedstock to preferably 250° C. and or most preferably up to 425° C. for magnesium alloy. It is further, object of this invention to control feedstock temperature in a closed loop with variation of the set point temperature not more than +/−1° C. and provide cycle to cycle uniform and consistent temperature of the feedstock that is demanded by the type of the light alloy processing.

Further, another object of the present invention is to provide an apparatus that could effectively mix additives and modifiers to the feedstock for enhancement of casting properties of the part.

Another objective of this invention is to recover at least 45% of the heat from the downstream casting process or heat from hydraulic oil or other cooling medium from the process. Or, most preferably accomplish high rate of energy recovery from downstream processes and recover up to 75% of the heat from the process by putting it back into pre-heating feedstock.

Finally it is possible to have a process where energy input into the feedstock, and melting the feedstock and then injection of the feedstock into the mold, and then by removing heat from the casting and use that removed heat to pre-heat new feedstock and achieve closed energy balanced casting process.

It is understood that once volatiles and gasses molecules are removed from the feedstock reactor, these volatile compounds $O_2$ and $N_2$ as well as humidity can be removed by suitably placed upstream equipment well known in the industry that will not be described in this application. Angled section (see FIG. 1, top right) of material feedstock in feed system can also be used for $O_2$ and $N_2$ and humidity removal and or argon (fluidized cocktail) recycling and/or refining for re-use and usage conservation. Volatiles would be preferably removed at the intake point of the feedstock where is lowest temperature and $O_2$, $N_2$ and humidity can be condensed absorbed from the system.

In order to achieve the above set goals of the invention let us review FIG. 1. Referring now to FIG. 1 is a vertical cross-sectional view of the feedstock-conditioning reactor according to the preferred embodiment of the present invention. A feedstock-conditioning reactor has a substantially tubular reaction chamber 10 made from cylindrical structure 11, located centrally along the axis of the conditioner. Reaction chamber 10 has upper and lower portions. The bottom of the chamber is mounted into a structural scrubber gas heater plate 14 where inert scrubber gas is preheated prior to injection into a reactor chamber 10. A suitable scrubber gas, preferably inert gas like Argon (Ar) is heated by heater plate 14 and then passed trough gas chamber 20 and through scrubber gas baffle 50 by scrubber gas injector 30. Preferably, gas injector 30 comprises one or more gas amplifiers, similar to one made by company BRAUER™ from England and sourced in North America from NexFlow™. The gas amplifier is used to enhance scrubbing gas volume required to fluidize the feedstock with minimum argon consumption. Gas amplifiers 30 are used to provide a simple, cost effective means of using small amount of heated pressurized argon to accelerate a large amount of returned argon in the gas chamber. It uses the low volume of high pressure inert gas to produce a high velocity, high volume lower pressure gas flow necessary to create fluidization of the feedstock in the reactor chamber 10.

Conditioned substrate exits the reaction chamber via discharge port 55, which forms an opening in axially located discharge tube 40 passing from the reactor chamber through the perforated baffle plate 50 into gas accumulation chamber 20 and then centrally passing through the base plate housing structure and therefore creating an output passage 60 for pre-heated and conditioned feedstock that can be further conveyed to the down stream process.

Similarly, inputting feedstock into the reactor chamber 10 is accomplished via the centrally positioned substrate feed port or tube 9, which is 30-60 mm in diameter and enters through the reactor cover plate 7. Just beneath the lower outlet of the in-feed tube is positioned cowl 8 which is formed as an inverted, right circular cone flange which surrounds or covers discharge tube 40. This immersed, circular cone flange (see 8 on FIG. 2) may force the feedstock to follow a more defined path on its way to the outlet tube 40. The purpose of the cowl is to spread incoming feedstock uniformly around the reactor chamber and to act as a separator to divide the reaction chamber into first portion 10*a* located outside the cowl and second portion 10*b* located inside the cowl. A secondary purpose of the cowl is to guide pre-heated feedstock into an outgoing tube 40 such that the feedstock travels as indicated by arrows 51 and 54 which is in part counter to the flow of scrubber gas shown by arrow 53. The outgoing tube 40 is threaded into a housing structure 14 (heater plate) and adjustable in height relative to the assembly. The reactor cover plate also houses two thermocouples 100 and 101 that each provides temperature feedback to controls system mounted elsewhere. Thermocouple 100 (T/C#1) is positioned to measure temperature of the feedstock adjacent where the feedstock enters the reaction chamber. Thermocouple 101 (T/C#2) is placed to detect temperature of the feed stock adjacent the vicinity of the baffle plate 50. The volume and pressure of the hot inert gas will be controlled by the differential temperature of these two set points to ensure that the differential temperature is minimal. Minimum differential temperature translates into uniform heating from bottom to top of the feedstock in the reactor chamber.

The reactor chamber is filled by feedstock up to 5-30 mm below port 55 of the outflow pipe 40. This is done to ensure that reduced volume density of the feedstock during fluidization will get up to the rim of the outflow pipe and with fine regulation of the volume of the inert gas cocktail (mixture of inert and functional gasses) and at the correct temperature feedstock will leave the reactor chamber trough the outflow tube 40. Incoming feedstock material will be replenishing outgoing heated feedstock, by directed flow to the side of the reactor chamber absorbing heat from the heat exchanger coils 80 so that continues flow of pre-heated and preconditioned feedstock will be maintained. By using argon with higher specific density than Oxygen and Nitrogen, it will naturally displace $O_2$ and $N_2$ attached to particles of feedstock and push water vapor, contaminants and residuals out trough the incoming supply pipe 9 and vent it in the containment vessel or be absorbed by upstream equipment out of the feedstock.

Figure 2:
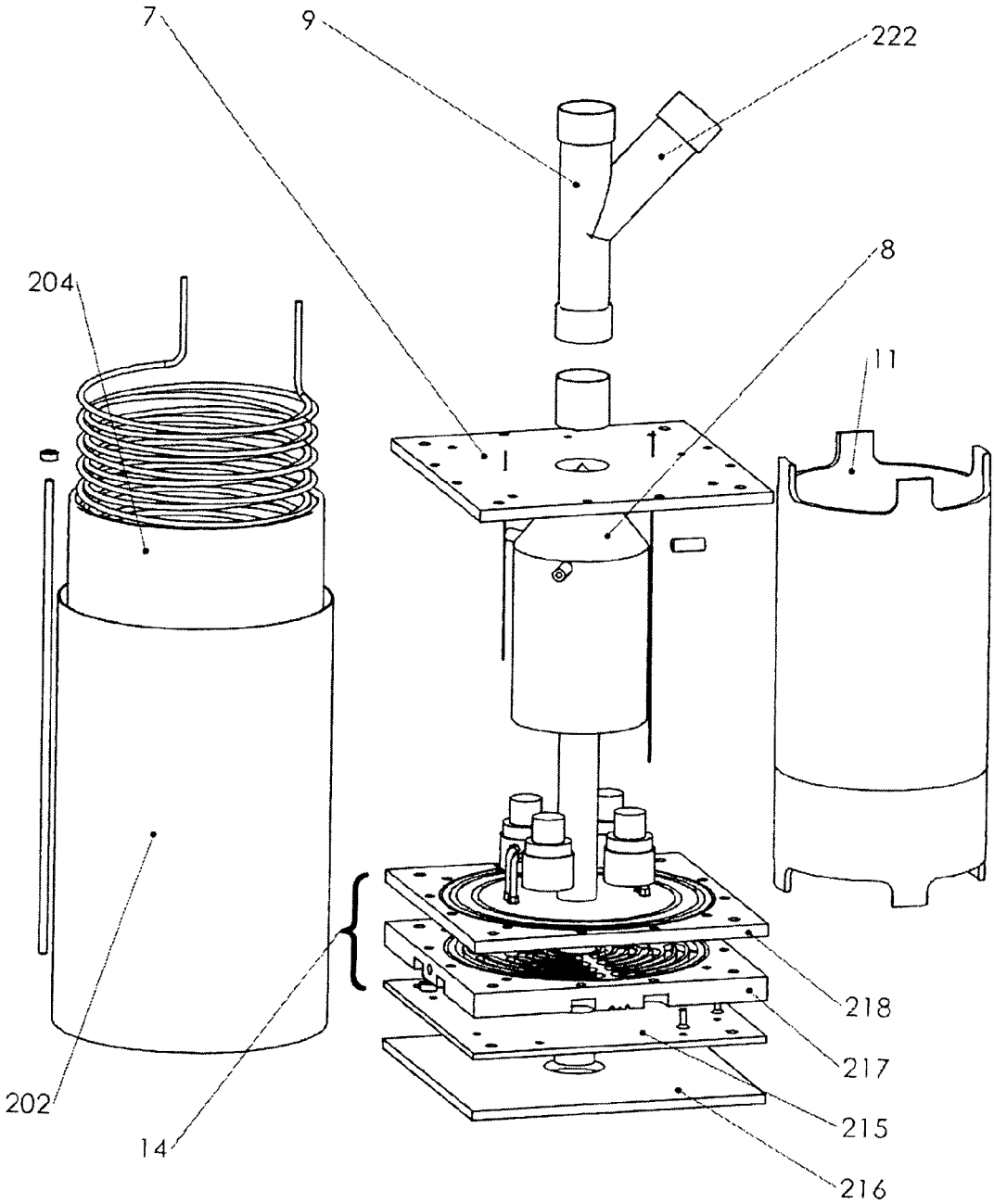
FIG. 2. is a exploded view of the preferred embodiment for this invention.

Surrounding the reactor containment tube 11 is external containment tube 204. There exists a space between inner reactor tube 11 and outer containment tube 204 to facilitate return of the hot inert gas accumulated in the area of the cone 8. The gas amplifiers are suctioning return gas and combining it with heated inert gas and continually repeating this cycle. Return gas is therefore flowing between two cylinders. The space between cylinders 11 and 204 forms a mantle 70 which houses heat recovery coils 80 of the energy heat exchanger tubes within, which will return energy from the downstream process and deposit it into the feedstock. Additionally, thermal insulation is provided in the co-axial cavity between cylinders 202 and 204 to increase overall energy recovery efficiency Referring now to FIG. 2 shows reactor structure in an exploded view with basic display of components and their functional relationships. Finally, external to the feedstock conditioner is coaxially located an external steel tube 202 covering over level of heat insulation not shown. Further we can see the bottom structural heater plate 14 broken down into its functional elements. At the top of the cover plate 7 is mounted the incoming feedstock supply tube 9 with side opening 222 for adding additives and alloy enhancing elements like additional metals, alloys, ceramics, oxides, whiskers, colorants etc., simply called functional additives.

The bottom structural heater plate is a sandwich made of gas heater plate 217, gas amplifier base plate 218 and, at the bottom of the conditioner, the gas heater cover plate 215. This plate also has an insulating plate 216. Gas heater plate 217 contains from the bottom side grooves for cable heaters. At the top side are gas grooves made to allow for fast heating of the inert gas or gas cocktail.

Figure 3:
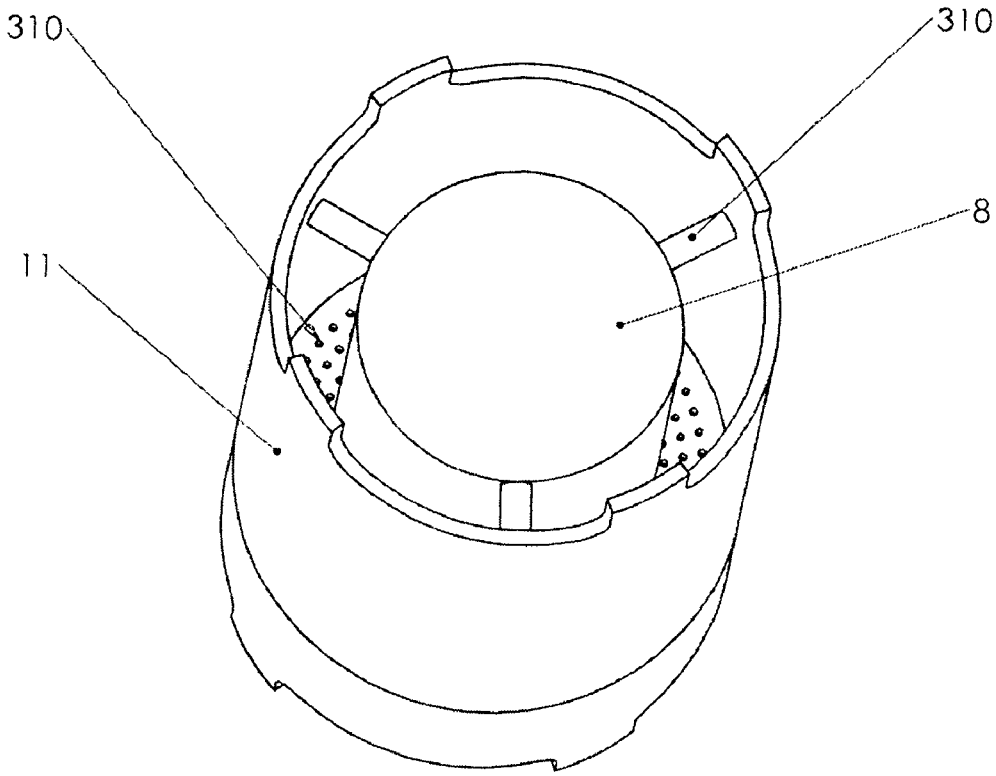
FIG. 3. is a schematic enlarged view of the reactor chamber according to embodiments of the present invention.
Figure 4:
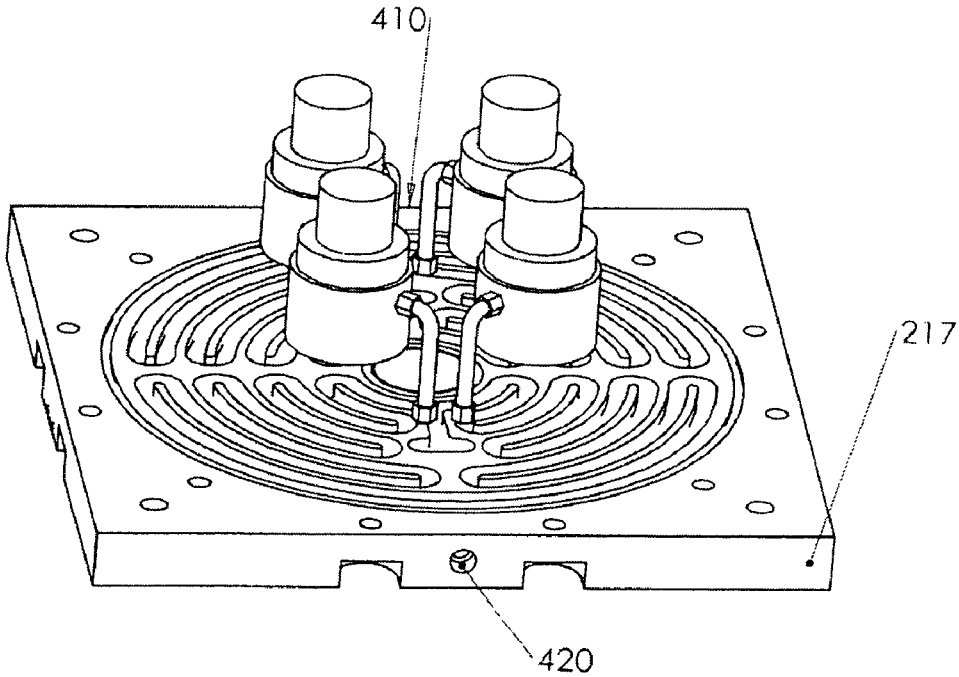
FIG. 4. is a schematic isometric view of the lower part of a fluidized bed reactor shown with amplifiers for fluidizing medium and pre-heater plate.

Let us now turn to FIG. 3, representing the inner reactor cylinder 11. Inner reactor cylinder 11 is made from highly thermally conductive material that will conduct heat from outside from the energy exchange tubs and also maintain uniform temperature along inner reactor wall. The inner reactor cylinder has a perforated floor 310 to facilitate inner gas passage from the gas amplifiers at the bottom gas accumulation area. Cylinder wall 11 is carved to facilitate feedstock containment and gas return passage. Inverted cone 8 is mounted with three standoff pins 320 to support the cone is extended axially to form preferred flow of the feedstock Referring now to FIG. 4, represents inert gas heating plate 217 that accepts supply of the inert gas at inlets 410 and 420. Heating plate is shown without sealed cover plate. At the bottom of the heating plate is a resistive or inductive heater. Grooves shown represent gas paths. Two independent gas flows are shown to improve heating efficiency.

Figure 5:
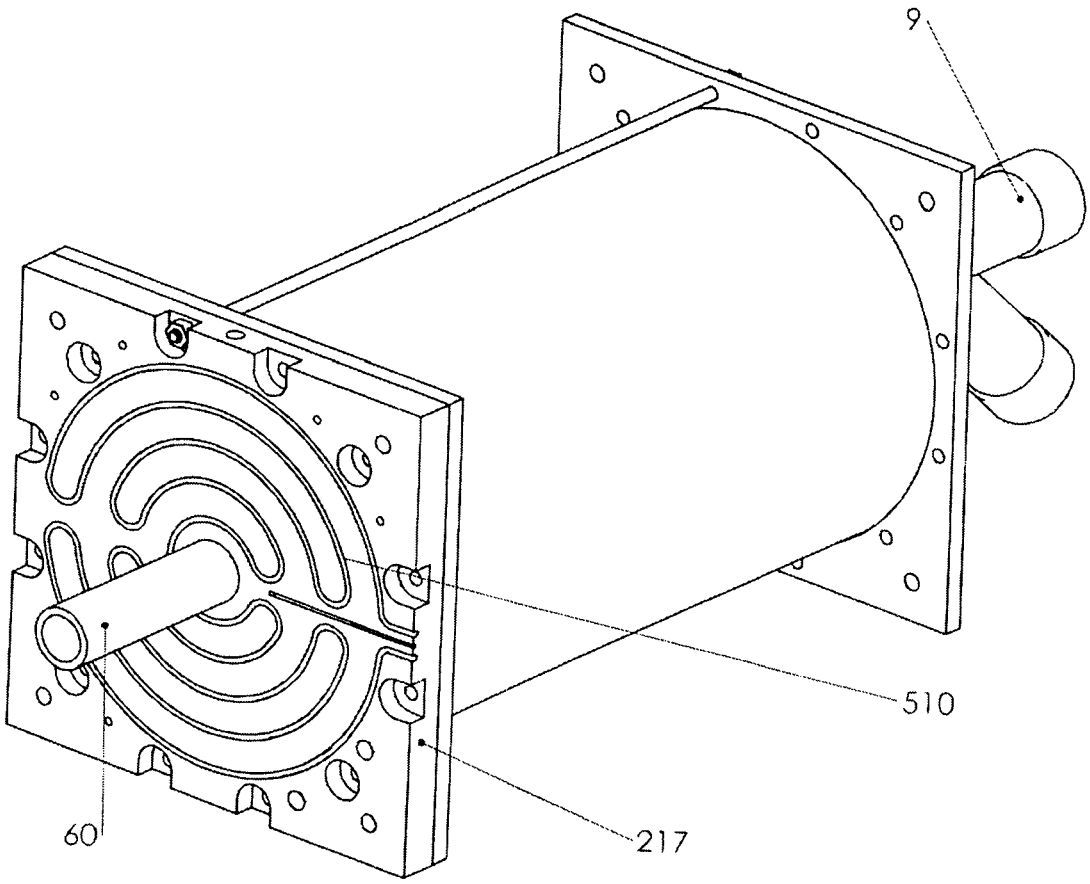
FIG. 5. is a perspective view of one form the conditioner assembly with heater plate.
Figure 6:
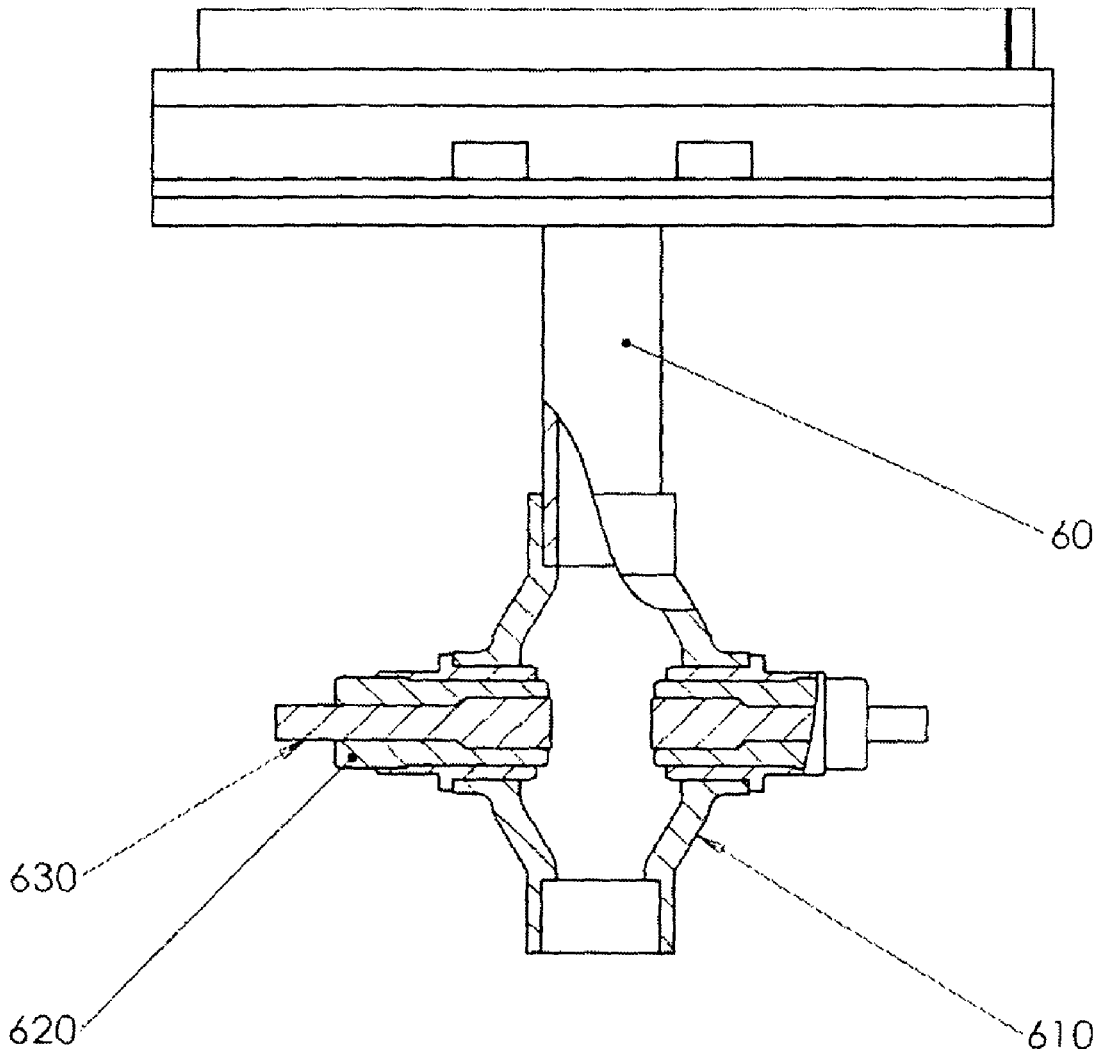
FIG. 6. is a schematic vertical elevation view of plasma heater for feedstock heating up to 460° C.

Let us now see FIG. 5, representing the fully assembled view of the feedstock conditioner without bottom insulating plate and gas heater cover plate. The bottom side of the heater plate 217 shows heaters installed into grooves. The feedstock conditioner works by creating fluidized feedstock that will uniformly heat and burn all contaminants. $O_2$ and $N_2$ molecules mixed with humidity and water molecules will move up from the reactor and only clean feedstock at uniform temperature is discharged via exit pipe 60. Firstly, feedstock material is supplied into the input supply tube 9. Feedstock material is then uniformly distributed into a fluidizing bed. Once heated, feedstock material is dropped through the central out flowing pipe 60 to the plasma chamber as partially schematically shown on FIG. 6. It is anticipated that other sources of heating like direct heating of fluidizing medium is envision by using plasma source of heat. Plasma heaters could be easily incorporated in at least one-gas amplification devices 413 or elsewhere in the inert gas-feedstock path. Any type of the plasma heating is acceptable as long as temperature of the inert gas or fluidizing medium does not exceed 425° C. for case of processing Magnesium. The microwave activated plasma, induction plasma, gliding arc discharge plasma etc could be used in this specification. The type of plasma used could be DC but preferably three phase. AC (Alternating Current) plasma is most optimal for this application.

It is envisioned that plasma generating system uses three electrodes inside a gas flow chamber creating synchronizing three phase plasma moving with frequency of supply around electrodes. It is not necessary to heat only fluidizing medium, it could also be possible heat mixture of inert gasses with feedstock in a plasma chamber. In operation, plasma is generated by application of electromagnetic field upon ionized inert gas, the applied field induces Eddy currents in the ionized medium and by means of Joule heating, and stable plasma is sustained. The operation of the electromagnetically sustained plasma in a plasma chambers, including ignition of plasma, is believe to be otherwise within the knowledge of one of ordinary skill in the art and does not need to be further described in the present specification.

The plasma chamber contains:

610: Plasma housing—ultra high frequency energy transparent or absorbent material.

620: Insulator

630: Electrode—Electromagnetic energy source conduit.

Energy could be electrical high frequency or micro wave to facilitate arc establishment and plasma maintenance. Plasma reactors and its benefits to the processing materials is well known and disclosed in patent to Hollis, Jr. et all U.S. Pat. No. 4,745,338. The secondary heating is used as an optional means of heating. It is preferable that only recovered heat is used for feedstock re-heating and scrubbing.

Once pre-heated, feedstock material is dropped through the plasma chamber and finally feedstock material reach process feedstock delivery pipe (not shown on FIG. 6) that is connected to injection casting machine (not shown) for further processing.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A device for conditioning a comminuted light alloy feedstock comprising:

a. a reaction chamber having a first end and a second end, a substrate feed port for feeding the comminuted light alloy feedstock into the reaction chamber positioned adjacent the first end of the reaction chamber and a scrubber gas baffle positioned adjacent the second end of the reaction chamber for releasing a scrubber gas into the reaction chamber;

b. a scrubber gas injector for adjusting the volume and rate of flow of the scrubber gas released through the scrubber gas baffle sufficiently to fluidize the comminuted light alloy feedstock in the reaction chamber;

c. a scrubber gas heater for heating the scrubber gas to a temperature sufficient to condition the comminuted light alloy feedstock as desired, and d. a discharge port for allowing the conditioned comminuted light alloy feedstock to exit the reaction chamber.

2. The device of claim 1 wherein the scrubber gas baffle comprises a perforated plate positioned in the reaction chamber separating the reaction chamber from a gas accumulation chamber which is coupled to the scrubber gas injector.

3. The device of claim 2 further comprising a separator for separating the reaction chamber into first and second reaction chamber portions, the first reaction chamber portion being coupled to the substrate feed port and the second reaction chamber portion being coupled to the discharge port.

4. The device of claim 3 wherein the separator, the substrate feed port, the discharge port and the perforated plate are positioned relative to each other such that the comminuted light alloy feedstock passes from the substrate feed port to the discharge port in a counter current arrangement to the heated scrubber gas.

5. The device of claim 4 wherein the discharge port comprises a discharge tube having an opening dimensioned to receive the comminuted light alloy feedstock which has been conditioned, the discharge tube extending into the reaction chamber with the opening of the discharge tube positioned between the first and second ends of the reaction chamber, the separator forming a cowl dimensioned to fit in the reaction chamber and extend over a portion of the discharge tube adjacent the opening, the first reaction chamber portion being outside of the cowl and the second reaction chamber portion being contained within the cowl.

6. The device of claim 5 wherein the cowl has a cone portion and wherein the cowl is positioned in the reaction chamber relative to the substrate feed port such that the cone portion channels the comminuted feed stock substrate into the first reaction chamber portion.

7. The device of claim 6 wherein the reaction chamber, discharge tube and cowl are all coaxially aligned.

8. The device of claim 5 wherein the discharge tube is selectively movable within the reaction chamber such that the position of the opening is adjustably movable between the upper and lower ends of the reaction chamber.

9. The device of claim 1 further comprising a first temperature sensor contained in the reaction chamber for measuring a first temperature of the comminuted light alloy feedstock adjacent the feed port and a second temperature sensor contained in the reaction chamber for measuring a second temperature of the comminuted light alloy feedstock adjacent the scrubber gas baffle, the gas heater being configured such that the first and second temperatures are within about 5.degree.C.

10. The device of claim 2 further comprising a gas amplifier in the gas accumulation chamber for directing the heated scrubber gas towards the perforated plate.

11. The device of claim 10 wherein the reaction chamber and gas accumulation chamber are configured such that the scrubber gas is continuously re-circulated within the device.

12. The device of claim 1 further comprising a heat exchange coil for heating the reaction chamber using heat energy extracted from a downstream process.

13. The device of claim 12 wherein the reaction chamber and gas accumulation chamber are configured such that the scrubber gas is continuously re-circulated within the device and wherein the heat exchange coil is contained in a mantle surrounding the reaction chamber, the scrubber gas passing through the mantle as it re-circulates within the device.

14. The device of claim 13 further comprising a mantle surrounding the reaction chamber, the mantle being configured such that the scrubber gas re-circulates between the reaction chamber and the gas accumulation chamber through the mantle, the mantle containing heating coils.

15. The device of claim 1 wherein the gas heater is configured to heat the scrubber gas to a temperature of between about 150.degree.C. to about 425.degree.C.

16. The device of claim 1 further comprising a secondary heater for heating comminuted light alloy feed stock exiting the discharge port.

17. A device for conditioning a comminuted light alloy feedstock comprising: a. a reaction chamber having a substrate feed port for feeding the comminuted light alloy feedstock into the reaction chamber; a scrubber gas baffle positioned at one end of the reaction chamber; c. a scrubber gas injector coupled to the scrubber gas baffle for injecting a scrubber gas trough the scrubber gas baffle at a volume and rate of flow sufficient to fluidize the comminuted light alloy feedstock in the reaction chamber; d. a scrubber gas heater for heating the scrubber gas to a temperature sufficient to condition the comminuted light alloy feedstock as desired, and e. a discharge port for allowing the conditioned comminuted light alloy feedstock to exit the reaction chamber.

18. The device of claim 17 wherein the scrubber gas injector comprises at least one gas amplifiers contained within a gas accumulation chamber positioned adjacent the scrubber gas baffle, the gas amplifier oriented to direct the scrubber gas towards the scrubber gas baffle.

19. A method of conditioning a comminuted light alloy feedstock using the device of claim 1, said method comprising the steps of:

a. adding a quantity of the comminuted light alloy feedstock into the reaction chamber;

b. adjusting the volume and rate of flow of the scrubber gas through the reaction chamber sufficiently to fluidize the comminuted light alloy feedstock;

c. adjusting the temperature of the scrubber gas sufficiently to heat the comminuted light alloy feedstock to a temperature of between about 150° C. to about 425° C., wherein the scrubber gas comprises a substantially inert gas.

20. The method of claim 19 wherein the scrubber gas comprises argon.

* * * * *

UNITED STATES PATENT AND TRADEMARK OFFICE

CERTIFICATE OF CORRECTION

PATENT NO. : 8,119,073 B2
APPLICATION NO. : 12/194838
DATED : February 21, 2012
INVENTOR(S) : Ashley Stone and Martin Kestle It is certified that error appears in the above-identified patent and that said Letters Patent is hereby corrected as shown below:

In the Claims

Replace Claim 8-20, with new claims 8-20 as issued with the following:

8. The device of claim 1 further comprising a first temperature sensor contained in the reaction chamber for measuring a first temperature of the comminuted light alloy feedstock adjacent the feed port and a second temperature sensor contained in the reaction chamber for measuring a second temperature of the comminuted light alloy feedstock adjacent the scrubber gas baffle, the gas heater being configured such that the first and second temperatures are within about 5° C.

9. The device of claim 2 further comprising a gas amplifier in the gas accumulation chamber for directing the heated scrubber gas towards the perforated plate.

10. The device of claim 9 wherein the reaction chamber and gas accumulation chamber are configured such that the scrubber gas is continuously re-circulated within the device.

11. The device of claim 1 further comprising a heat exchange coil for heating the reaction chamber using heat energy extracted from a downstream process.

12. The device of claim 11 wherein the reaction chamber and gas accumulation chamber are configured such that the scrubber gas is continuously re-circulated within the device and wherein the heat exchange coil is contained in a mantle surrounding the reaction chamber, the scrubber gas passing through the mantle as it re-circulates within the device.

Signed and Sealed this
Twenty-eighth Day of July, 2015

Michelle K. Lee

Michelle K. Lee
*Director of the United States Patent and Trademark Office*

13. The device of claim 1 wherein the gas heater is configured to heat the scrubber gas to a temperature of between about 150° C. to about 425° C.

14. The device of claim 1 further comprising a secondary heater for heating comminuted light alloy feed stock exiting the discharge port.

15. The device of claim 5 wherein the discharge tube is selectively movable within the reaction chamber such that the position of the opening is adjustably movable between the upper and lower ends of the reaction chamber.

16. A method of conditioning a comminuted light alloy feedstock using the device of claim 1, said method comprising the steps of:

a. adding a quantity of the comminuted light alloy feedstock into the reaction chamber;

b. adjusting the volume and rate of flow of the scrubber gas through the reaction chamber sufficiently to fluidize the comminuted light alloy feedstock;

c. adjusting the temperature of the scrubber gas sufficiently to heat the comminuted light alloy feedstock to a temperature of between about 150° C. to about 425° C., wherein the scrubber gas comprises a substantially inert gas.

17. The method of claim 16 wherein the scrubber gas comprises argon.

18. A device for conditioning a comminuted light alloy feedstock comprising: a. a reaction chamber having a substrate feed port for feeding the comminuted light alloy feedstock into the reaction chamber; a scrubber gas baffle positioned at one end of the reaction chamber; c. a scrubber gas injector coupled to the scrubber gas baffle for injecting a scrubber gas trough the scrubber gas baffle at a volume and rate of flow sufficient to fluidize the comminuted light alloy feedstock in the reaction chamber; d. a scrubber gas heater for heating the scrubber gas to a temperature sufficient to condition the comminuted light alloy feedstock as desired, and e. a discharge port for allowing the conditioned comminuted light alloy feedstock to exit the reaction chamber.

19. The device of claim 18 wherein the scrubber gas injector comprises at least one gas amplifiers contained within a gas accumulation chamber positioned adjacent the scrubber gas baffle, the gas amplifier oriented to direct the scrubber gas towards the scrubber gas baffle.

20. The device of claim 12 further comprising a mantle surrounding the reaction chamber, the mantle being configured such that the scrubber gas re-circulates between the reaction chamber and the gas accumulation chamber through the mantle, the mantle containing heating coils.